United States Patent [19]

Casull

[11] 4,228,607

[45] Oct. 21, 1980

[54] SINGLE ACTION REVOLVER WITH SAFETY LOCKING CYLINDER

[76] Inventor: Richard J. Casull, P.O. Box 188, Freedom, Wyo. 83120

[21] Appl. No.: 962,140

[22] Filed: Nov. 20, 1978

Related U.S. Application Data

[63] Continuation-in-part of Ser. No. 759,416, Jan. 14, 1977, Pat. No. 4,126,953.

[51] Int. Cl.[3] ..... F41C 1/00

[52] U.S. Cl. ..... 42/66

[58] Field of Search ..... 42/66, 65, 59

[56] References Cited

U.S. PATENT DOCUMENTS

| | | | |
|---|---|---|---|
| 990,669 | 4/1911 | Rodehaver | 42/59 |
| 1,898,237 | 2/1933 | Bocco | 42/59 |

*Primary Examiner*—Charles T. Jordan

*Attorney, Agent, or Firm*—Criddle & Western

[57] ABSTRACT

A single action single barreled revolver having an oscillating arm trippet retained in the hammer cavity which interacts with the cylinder latch to rotate the cylinder in battery position or in the alternative allow the firing pin to be positioned in a cylinder notch in the cylinder web between the cylinder chambers thereby locking the cylinder in a safety or non-battery position.

1 Claim, 7 Drawing Figures

SINGLE ACTION REVOLVER WITH SAFETY LOCKING CYLINDER

BACKGROUND OF THE INVENTION

This application is a continuation-in-part of Ser. No. 759,416 Filed Jan. 14, 1977 now Pat. No. 4,126,953.

This invention relates to single action revolvers. More particularly, this invention relates to single barreled action revolvers having a novel method for caming the cylinder latch over other single action revolvers and for locking the cylinder in a safety or non-battery position.

Single action revolvers conventionally have a recycle plunger cam attached to the hammer or have a set cam on the hammer and the recycle action on the cylinder latch the latter leaving a very fragile part. Moreover, most single action, single barreled revolvers, when a cylinder is in other than a loading position, maintains a cylinder chamber in register with the barrel. In other words, if a cartridge is contained in the cylinder chamber in register with the barrel, the revolver is in battery position. Although the hammer may be in a so called safety position there is always the inherent danger of the hammer being accidentally released and striking the firing pin, thereby unintentionally discharging the cartridge.

OBJECTS OF THE INVENTION

It is an object of the present invention to provide a unique and different method of caming the cylinder latch over other single action revolvers.

It is also an object of the invention to use an oscillating arm trippet that is retained and pivots off the hammer axis screw for recycle purposes of operating the cylinder latch.

A still further object of the invention is to provide a stronger and more durable single action revolver which gives a wider sear surface to the hammer for more strength.

Again an object of the invention is to provide a safety feature for a single action single barreled revolver by utilizing a simple unique way of keeping a single action revolver completely safe even when the cylinder is fully loaded with cartridges.

A still further object of the invention is to provide a novel cylinder latch spring being shaped so as to give spring tension to the cylinder bolt and also to keep the cylinder latch axis pin in the frame without the use of screw threads as is conventionally done in other revolvers.

A still further object of the invention is to provide a trigger spring which functions to give tension to the trigger for sear engagement and also to retain the trigger axis pin securely in the frame.

These and other objects may be accomplished by means of a single action revolver. The revolver contains an oscillating trippet housed in the hammer cavity. The trippet functions to lift the underneath side of the cylinder latch when the hammer is placed in the loading position thereby allowing freedom of rotation of the cylinder. However, upon pulling the hammer back into a cocked or fully loaded position the trippet further rotates causing it to disengage from the cylinder latch arm allowing the cylinder latch under spring tension to return to its original position to lock the cylinder in battery position. When the hammer is reversed or allowed to fall the trippet, having a cam angle in the lower half of the toe thereof, contacts the cylinder latch arm causing the trippet to oscillate under spring tension into the hammer cavity and bypass the side of the cylinder latch arm and to snap back into place under spring tension for a new cycle.

When the hammer is in a loading position the cylinder freely rotates. Holes drilled in the cylinder web between the chambers allows the firing pin to be inserted into one of the holes when the trigger is pulled and the hammer is in an uncocked position thereby locking the cylinder with the chambers being out of register with the barrel thereby preventing any chance of the hammer striking the firing pin and accidentally discharging a cartridge.

The novel features of this invention both as to the manner of construction or organization as well as the operation will be better understood with reference to the following description and drawings. It is to be understood however, that the description and drawings are for the purpose of illustration only and not intended to be a definition as to the scope of this invention.

DRAWINGS OF THE INVENTION

DETAILED DESCRIPTION OF THE INVENTION

There is shown in FIGS. 1-7 a complete operative embodiment of the invention with its attendant advantages.

Figure 1:
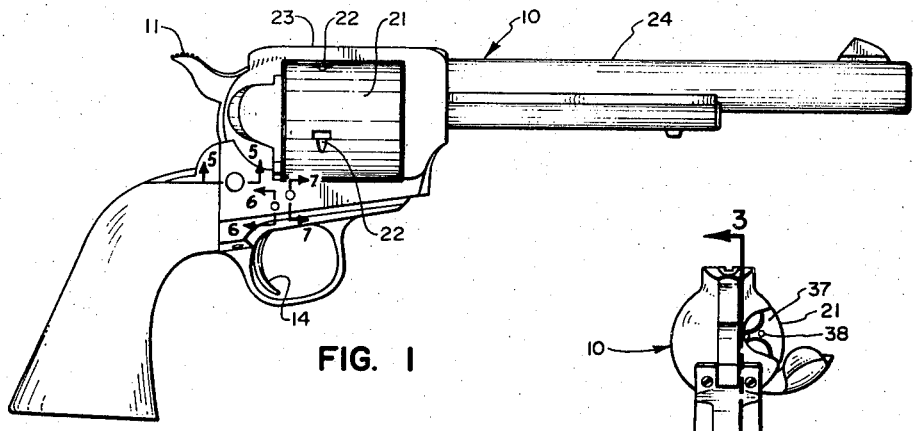
FIG. 1 is a side elevational view of a revolver according to the present invention.

There is shown in FIG. 1 a typical single action revolver 10 having a hammer 11, a trigger 14, a frame 23, a barrel 24 and a revolving chambered cylinder 21. Notches 22 for locking the cylinder with a cylinder chamber in alignment with the barrel to form a battery are also illustrated.

Figure 2:
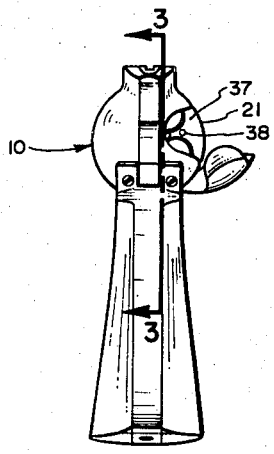
FIG. 2 is a rear elevation view of the revolver according to the present invention with the loading gate swung open showing portions of the cylinder web, cylinder chambers and locking hole between the cylinder chambers.
Figure 3:
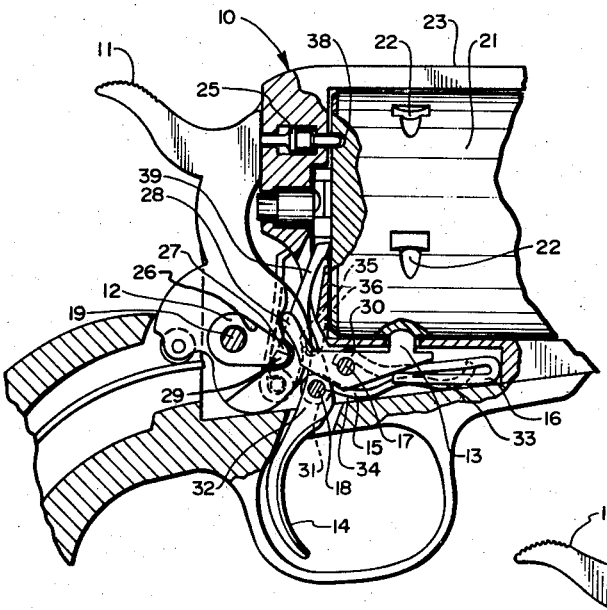
FIG. 3 is a partially broken away view of the hammer, trigger and cylinder portions of the invention showing the firing pin in a cylinder locking position and the hammer in a closed position taken along lines 3—3 of FIG. 2.

FIG. 2 shows a rear elevational view of a conventional single action revolver with the loading gate open exposing a portion of the cylinder web 37 of the cylinder 21 containing cartridge chambers and holes 38 in the cylinder web between the cartridge chambers.

The invention comprises several embodiments all or a part of which may be incorporated into one revolver as will be herinafter described. However, the novel mechanism for caming the cylinder latch and for locking the cylinder in a safety position could be utilized on separate revolvers.

As previously mentioned most single action revolvers have either a recylce plunger cam attached to the hammer or have a set cam on the hammer and the recycle action of the cylinder latch leaving the cylinder latch as a very fragile part.

The present invention significantly provides the means and method of caming the cylinder latch with a stronger, more durable assembly which is easier to clean, gives a wider sear surface to the hammer for more strength and provides ease in manufacture and assembly.

Figure 4:
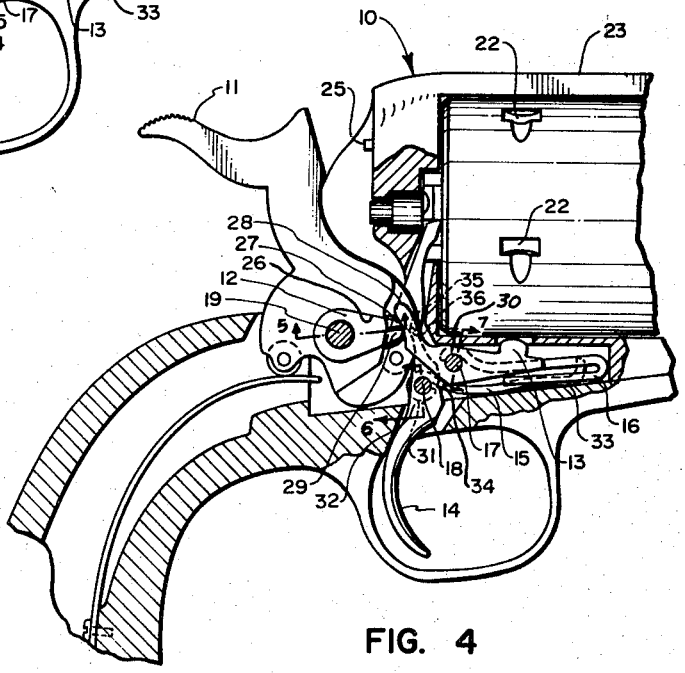
FIG. 4 is a partially broken away view of the hammer, trigger and a portion of the cylinder showing the hammer in a loading position and the cylinder latch disengaged.
Figure 5:
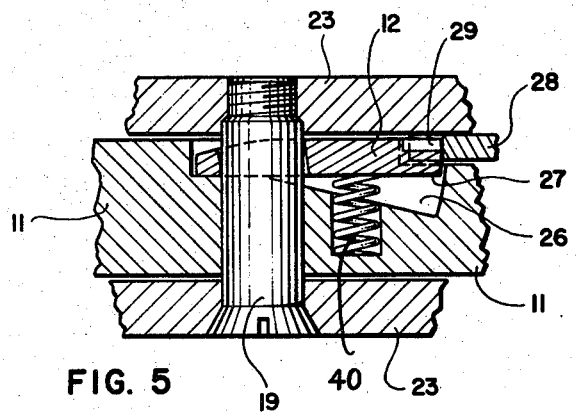
FIG. 5 is a partial view of the hammer, hammer axis screw, trippet, trippet spring, and hammer cavity taken along lines 5—5 of FIGS. 1 and 4.
Figure 6:
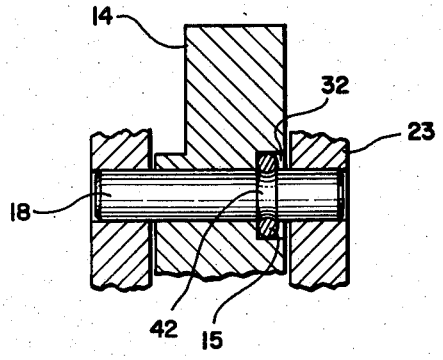
FIG. 6 is a partial view of the trigger, trigger spring, trigger axis pin, and the notch in the trigger axis pin taken along lines 6—6 of FIGS. 1 and 4.
Figure 7:
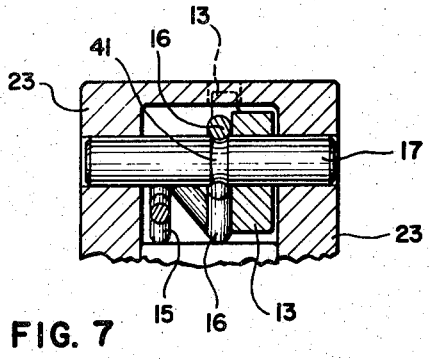
FIG. 7 is a partial view of the cylinder latch, cylinder latch spring, cylinder latch axis pin, and the notch in the cylinder latch axis pin taken along 7—7 FIGS. 1 and 4.

This may be accomplished by the utilization of a hammer 11 having a cavity 26 therein housing an oscillating arm trippet 12 that is retained and pivots about the hammer screw axis 19. Trippet 12 is held in place by frame 23 and trippet spring 40. When hammer 11 is being pulled back toward a cocked position trippet arm 12 rotates backward with the hammer. The toe 27 of the trippet is lifted to engage the underneath side of cylinder latch arm 28. As the hammer 11 is further pulled back the toe 27 of the tripped lifts cylinder latch arm 28 pivoting the cylinder latch 13 out of the cylinder notch 22 allowing the cylinder 21 to rotate. The cylinder freely rotates when hammer 11 is in a half-cocked or loading position. The loading notch 35 in the hammer is in engagement with trigger sear 36 as shown in FIG. 4 and the cylinder latch arm 28 lifted by trippet 12 depresses cylinder latch 13 causing said latch to be disengaged from cylinder notch 22. The cylinder thus rotates freely in one direction. The hand 39 prevents rotation in the opposite direction by engagement with the cylinder cam. With the cylinder latch 13 depressed cylinder latch spring 16 is depressed or placed under tension. Further backward pressure on the hammer 11 to a fully cocked position causes the trippet 12 to disengage the cylinder latch arm 28 allowing the cylinder latch 13 under spring tension from cylinder latch spring 16 to return to its original position to engage cylinder notch 22 in cylinder 21 placing the revolver in a battery position.

When the hammer 11 is reversed in position by firing the revolver or by slowly releasing it forward the trippet 12 having a cam angle 29 on trippet toe 27 cut in the lower half of the trippet toe 27 contacts the cylinder latch arm 28, further rotation causes the cam angle 29 to oscillate the trippet 12 under spring tension into the hammer cavity 26 and bypass to one side of cylinder latch arm 28. As rotation continues the trippet 12 under spring tension from trippet spring 40 snaps back into place for a new cycle.

Most revolvers have a "safety" notch in the hammer that holds the hammer away from the firing pin mounted in the revolver frame but relatively adjacent thereto. Even with the hammer in the so-called safety position the chambers in the cylinder are so regulated by the hand that one chamber is always in alignment with the barrel. For this reason many instruction sheets accompanying new revolvers suggest that the safest way to carry the single action revolver is with one less cartridge in the cylinder chambers and the hammer on the empty chamber. The present invention provides a way of keeping a single action revolver completely safe with the cylinder chambers fully loaded. This is accomplished by placing the hammer 11 on the loading notch 35 engaging the trigger sear 36. The trippet 12 will have raised the cylinder latch arm 28 depressing cylinder latch 13 and cylinder latch spring 16. This lets the cylinder 21 rotate.

Apertures 38 drilled in cylinder web 37 between the chambers are of approximately the same diameter as the head of firing pin 25 mounted in revolver frame 23 and are adapted to be in alignment therewith.

Visible marks placed on the cylinder 21 tell when aperture 38 is in alignment with firing pin 25 with the chambers being on either side of the barrel. With the cylinder held in place the hammer 11 is slowly removed from notch 35 and let forward pressing firing pin 25 forward in frame 23 into aperture 38 forming a cylinder lock holding the cylinder 21 in place out of battery. Thus there is no way that the hammer can accidently slip, strike the firing pin and discharge a cartridge since the cartridges are locked out of alignment with the hammer and the barrel. By moving the hammer 11 backward into a fully cocked position the cylinder hand will rotate the cylinder 21 and cylinder latch 13 will lock the cylinder 21 in battery position.

Cylinder latch spring 16 gives spring tension to cylinder latch 13 and keeps cylinder latch axis pin 17 in position without the aid of thread screws as in other guns. The spring contains a hooked end 30 that arcs about a notch 41 in axis pin 17 with either the forward end forming an arc and terminating in an upwardly angling end or with the folded arm of the spring extending forwardly in tensioned relationship under cylinder latch 13. Pressure is placed on spring 16 both at the hooked end 30, the forward end and on cylinder latch 13 when the trigger guard is assembled to frame 23. The applied pressure or tension on hooked end 30 retains axis pin 17 in place.

Trigger spring 15 similarly fits into the same cavity between the frame 23 and trigger guard and contains a hooked end 31 that extends through the forward part of the trigger and arcs about a notch in trigger axis pin 18. Spring 15 arches or bows in a convex position terminating in an upwardly angling end. The hooked end 31 of the trigger spring functions to give tension to the trigger 14 for sear engagement while also tensioning the trigger axis pin 18 firmly in frame 23. The hooked end 31 of trigger spring 15 is housed in cavity 32 in the trigger 14 and is held in place by the inside surface of frame 23 and axis pin 18. As pressure is placed at point 33 near the upwardly angling end of trigger spring 14 the spring has a tendency to pivot at point 34 and place tension on the trigger 14 to provide sear engagement and also apply tension to the trigger axis pin 18 thus retaining said pin in frame 23 without the aid of screw threads.

With the component parts assembled as described the revolver is more easily assembled and durable than conventional single action revolvers and has the added safety feature of locking the cylinder with the firing pin wherein the cylinder chambers are not out of register with the barrel.

Although the invention as has been described is deemed to be that which would form the preferred embodiments, it is recognized that departures may be made therefrom without departing from the scope of the invention which is not to be limited to the details disclosed, but to be accorded the full scope of the claims so as to include all equivalent devices and apparatus.

I claim:

1. In a single action, single barreled revolver having a frame, a cylinder containing a single set of chambers, a hammer and a firing pin mounted in the frame rearwardly of the cylinder in alignment with the barrel the improvement which comprises a cylinder web containing a series of apertures located between the chambers into which the firing pin may be inserted when the cylinder has been rotated to place the firing pin in alignment with one of said apertures and when the hammer has been pressed forward thereby locking the cylinder such that the chambers are out of battery position.

* * * * *